United States Patent [19]

Ohta et al.

[11] Patent Number: 5,046,585

[45] Date of Patent: Sep. 10, 1991

[54] UPRIGHT ASSEMBLY FOR FORK LIFT TRUCK

[75] Inventors: Shuji Ohta; Toshiyuki Takeuchi, both of Kariya, Japan

[73] Assignee: Kabushiki Kaisha Toyoda Jidoshokki Seisakusho, Kariya, Japan

[21] Appl. No.: 482,695

[22] Filed: Feb. 21, 1990

[30] Foreign Application Priority Data

Feb. 23, 1989 [JP] Japan ..... 1-44294
Feb. 23, 1989 [JP] Japan ..... 1-44295

[51] Int. Cl.[5] ..... B66B 9/20
[52] U.S. Cl. ..... 187/9 E; 187/95
[58] Field of Search ..... 187/9 E, 9 R, 95

[56] References Cited

U.S. PATENT DOCUMENTS 2,888,300 5/1959 Curtis et al. ..... 187/9 E X
2,936,047 5/1960 Quayle ..... 187/9 E X
4,307,792 12/1981 Benson et al. ..... 187/9 E
4,921,075 5/1990 Schumacher et al. ..... 187/9 E

FOREIGN PATENT DOCUMENTS 49-49548 12/1974 Japan .
54-159575 11/1979 Japan .

*Primary Examiner*—Joseph E. Valenza
*Assistant Examiner*—Tuan N. Nguyen
*Attorney, Agent, or Firm*—Brooks Haidt Haffner & Delahunty

[57] ABSTRACT

An upright assembly for a fork lift truck is disclosed in which the assembly comprises an outer mast of U-shaped cross-section and an inner mast also of U-shaped cross-section that is received in the space within the outer mast. In order to keep the overall height of the upright assembly low, and to keep sliding resistance between the masts small, the inner mast is supported by an inner mast roller to counter the large forward moments and the inner mast is supported by liners to counter the small rearward moments.

14 Claims, 10 Drawing Sheets

UPRIGHT ASSEMBLY FOR FORK LIFT TRUCK

FIELD OF THE INVENTION

This invention relates to an upright assembly for a fork lift truck and, more particularly, to an upright assembly in which a U-shaped cross-sectional inner mast is received in a U-shaped cross-sectional outer mast to be elevationally movable therein.

BACKGROUND OF THE INVENTION

Heretofore, as upright assemblies for fork lift trucks, there have been known liner types in which an inner mast received in an outer mast is elevationally guided by a liner, and roller types in which an inner mast received in an outer mast is guided by rollers. Such upright assemblies of the inner mast receiving type have the feature of a forward field of view from the driver's seat greater than that of upright assemblies of the type where an outer mast and an inner mast are aligned in the lateral direction (right and left directions) of the fork lift truck.

FIG. 1 shows a conventional liner type upright assembly. In this upright assembly, liners 5 are interposed between the front and rear inner faces of an outer mast 1 and the front and rear outer faces of an inner mast 3 received in the outer mast 1, a side liner 7 is interposed between the side inner face of the outer mast 1 and the side outer face of the inner mast 3, and longitudinal and lateral moments acting on the inner mast 3 are supported by the liners 5, 7. A lift roller 11 attached to a lift bracket 9 is made to roll in a space inside the inner mast 3.

However, conventional liner type upright assemblies have problems in that sliding resistance between the masts 1 and 3 is large which adversely affects the lifting speed of the mast, thereby reducing efficiency. Further, the liners 5, 7 wear severely and it is hence necessary to frequently replace the liners, a complicated task that increases maintenance costs.

On the other hand, conventional roller type upright assemblies as disclosed in Japanese Patent Publication No. 49-49548 and Japanese Utility Model Laid Open No. 54-159575 are also known. FIGS. 2–4 show an upright assembly equivalent to those disclosed in these official gazette documents. As shown in the drawings, front and rear outer mast rollers 13 and 14 rolling on the front and rear outer faces of the inner mast 3 are attached to the upper end of the outer mast 1 through roller brackets 15, and small and large inner mast rollers 17 and 18 rolling on the front and rear inner faces of the outer mast 1 are attached to the lower end of the inner mast 3 through L-shaped roller brackets 19. Longitudinal moments are generated by the mast rollers 13, 14 and 17, 18. In this case, forward moments acting on the inner mast 3 are much larger than rearward moments, and the inner mast roller 18 at the rear side has a larger diameter. As shown in FIG. 2, lateral moments are supported by bringing the side face of the rear inner mast roller 18 having a large diameter into contact with a thick portion 1*a* formed at the inner corner of the outer mast 1. A lift roller 11 attached to a lift bracket 9 is so received as to roll in the inner space of the inner mast 3.

However, since the inner mast rollers 17 and 18 are disposed directly under the inner mast 3 in this roller type upright assembly, the lift roller 11 at the lowermost portion of the lift bracket 9 when it is disposed at its lowest position as shown in FIG. 3 must be at least the dimension D above the rear inner mast roller 18. Particularly, since the roller pin 21 of the inner mast roller 18 is only supported by one end on the L-shaped roller bracket 19, the roller pin 21 needs to be strengthened by increasing its diameter with the result that the diameter of the inner mast roller 18 is unavoidably increased. Thus, the lift roller 11 on the lift bracket 9 must be disposed at a considerably higher position than the lower end of the roller bracket 19 which is substantially the lower end of the inner mast 3, increasing the resultant overall height H of the upright assembly, with the result that there are cases where such an assembly cannot be used for loading/unloading in structures having low ceilings.

SUMMARY OF THE INVENTION

Accordingly, an object of this invention is to provide an improved upright assembly for a fork lift truck in which sliding resistance between an inner mast and an outer mast is minimized so that elevational movement of the inner mast can be carried out smoothly.

Another object of this invention is to provide an upright assembly for a fork lift truck in which the overall height thereof is made to be as low as possible.

Still another object of the invention is to provide an upright assembly for a fork lift truck in which a broad forward field Of view can be assured.

In order to achieve these and other objects, there is provided according to this invention an upright assembly for a fork lift truck having a U-shaped cross-sectional outer mast and a U-shaped cross-sectional inner mast received in the outer mast, wherein an outer mast roller rollably contacting the front outer face of the inner mast and a rear liner slidably contacting the rear outer face of the inner mast are mounted at the upper end of the outer mast, and an inner mast roller rollably contacting front outer face of the outer mast and a front liner slidably contacting the front inner face of the outer mast are mounted at the lower end of the inner mast.

As the arrangement of the upright assembly described above is of the type where the inner mast is received in the outer mast, a broad forward field of view can be assured.

In such an upright assembly, large forward moments acting on the inner mast are supported by the outer and inner mast rollers at the time of normal loading/unloading operations, and relatively small rearward moments acting at the time of traveling with an empty load are supported by the rear and front liners. More specifically, since the elevational movements of the inner mast at the time of loading/unloading are guided by the outer and inner mast rollers, its sliding resistance is low and elevational movements are smooth.

Further in relation to the fact that the inner mast roller is disposed at the front side of the outer mast, it is possible to dispose the lift roller of the lift bracket at the lower end of the inner mast when the lift bracket is disposed at its lowermost position. Therefore, the overall height of the upright assembly can be kept to a minimum as compared with a conventional roller type upright assembly. Thus, loading/unloading operations in structures having low ceilings becomes possible.

According to another embodiment of the present invention, there is provided an upright assembly for a fork lift truck in which the inner mast roller rollably contacting the rear inner face of the outer mast and the front liner slidably contacting the front inner face of the outer mast are mounted at the lower end of the inner mast. Further, in the upright assembly, a roller bracket for supporting the roller pin of said inner mast roller at both ends thereof is provided at the corner of the rear lower end of the inner mast, and the roller bracket is formed in substantially a triangular shape with the side opposing the lift roller on the lift bracket rolling in the U-shaped space of the inner mast as an oblique face.

With the arrangement of the upright assembly described above, similarly to the first embodiment, large forward moments acting on the inner mast at the time of normal loading/unloading operations are supported by the outer and inner mast rollers.

Related to the fact that the roller pin is supported at both ends by the roller bracket, the diameter of the roller pin of the inner mast roller can be reduced to decrease the diameter of the roller. Further, since the roller bracket, is formed substantially in a triangular shape with the side of the roller bracket opposing the lift roller of the lift bracket as the oblique face, the rising dimension from the lower end of the inner mast can be kept short. As a result, the lift roller can be so disposed that, when the lift bracket is at its lowermost position, it can approach the lower end of the inner mast as much as possible.

These and other objects and features of the present invention will become apparent from the following detailed description in conjunction with the attached drawings.

BRIEF DESCRIPTION OF THE DRAWINGS

In the following detailed description, references will be made to the attached drawings in which.

DESCRIPTION OF THE PREFERRED EMBODIMENT

Figure 1:
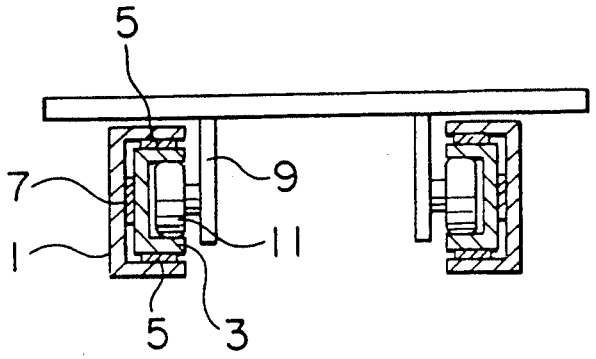
FIG. 1 (PRIOR ART)
FIG. 1 is a cross-sectional view schematically showing a conventional liner type upright assembly for a fork lift truck.
Figure 2:
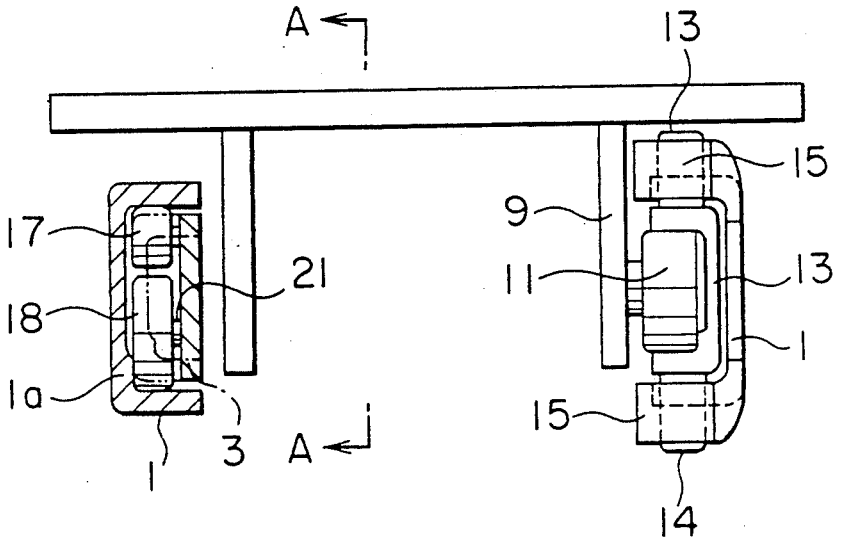
FIG. 2 (PRIOR ART)
FIG. 2 is a cross-sectional view schematically showing a conventional roller type upright assembly.
Figure 3:
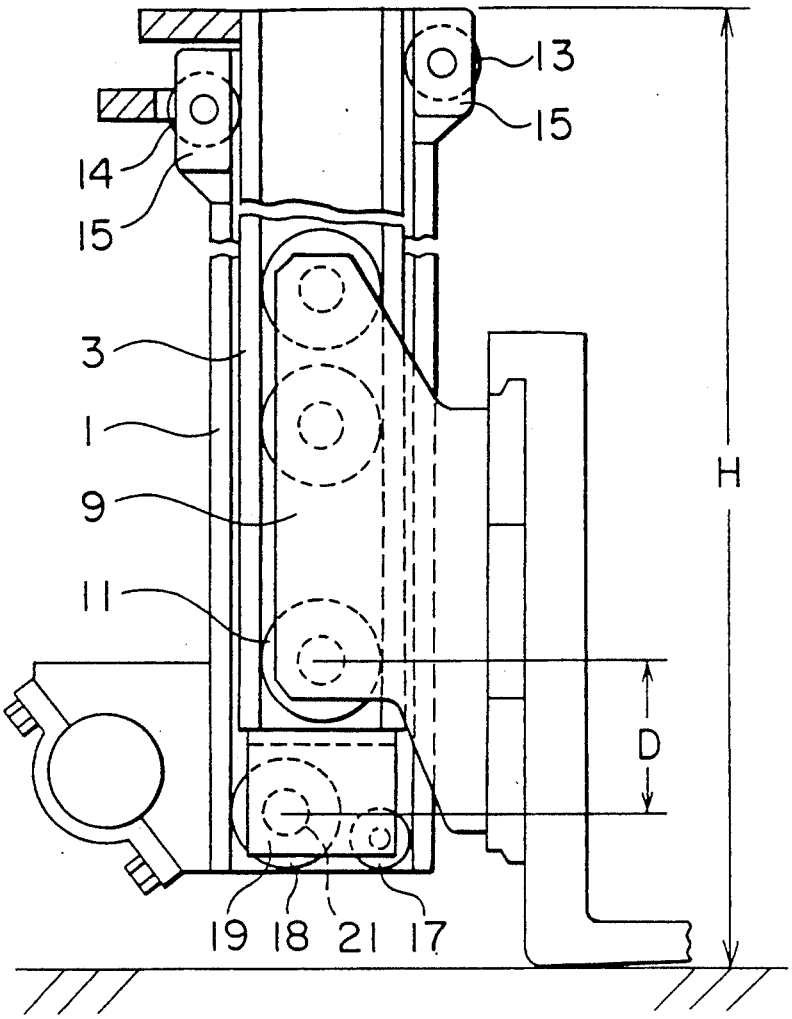
FIG. 3 (PRIOR ART)
FIG. 3 is a cross-sectional view of a conventional upright assembly taken along the line A—A of FIG. 2.
Figure 4:
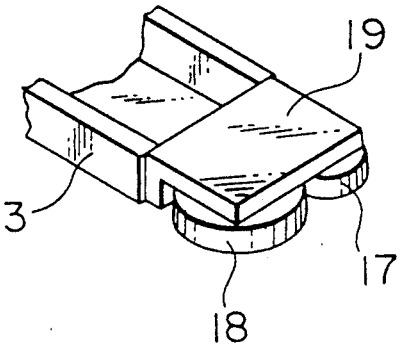
FIG. 4 (PRIOR ART)
FIG. 4 is a perspective view showing the attaching structure of an inner mast roller in a conventional roller type upright assembly.

Referring to FIGS. 5–12, a pair of right and left outer masts 51 are forwardly or rearwardly tiltably mounted at lower ends thereof to a truck body (not shown) through mast supports 53, and are tilted forward or rearward by tilt cylinders (not shown) coupled to tilt brackets 55 at substantially intermediate portions of the outer masts 51. The right and left outer masts 51 are formed in U-shaped cross section, and right and left inner masts 57 formed in U-shaped cross section are elevationally movably received in the inner spaces of the outer masts 51, respectively.

Outer mast rollers 59 rolling on the front outer faces of the inner masts 57 are attached to the front sides of the upper ends of the outer masts 51 through roller brackets 61. Inner mast rollers 63 rolling on the front outer faces of the outer masts 51 are attached to the front sides of the lower ends of the inner masts 57 through roller brackets 65, and forward (in a direction of arrow F in FIG. 6) moments acting on the inner masts 57 are supported by both the rollers 59 and 63.

Figure 8:
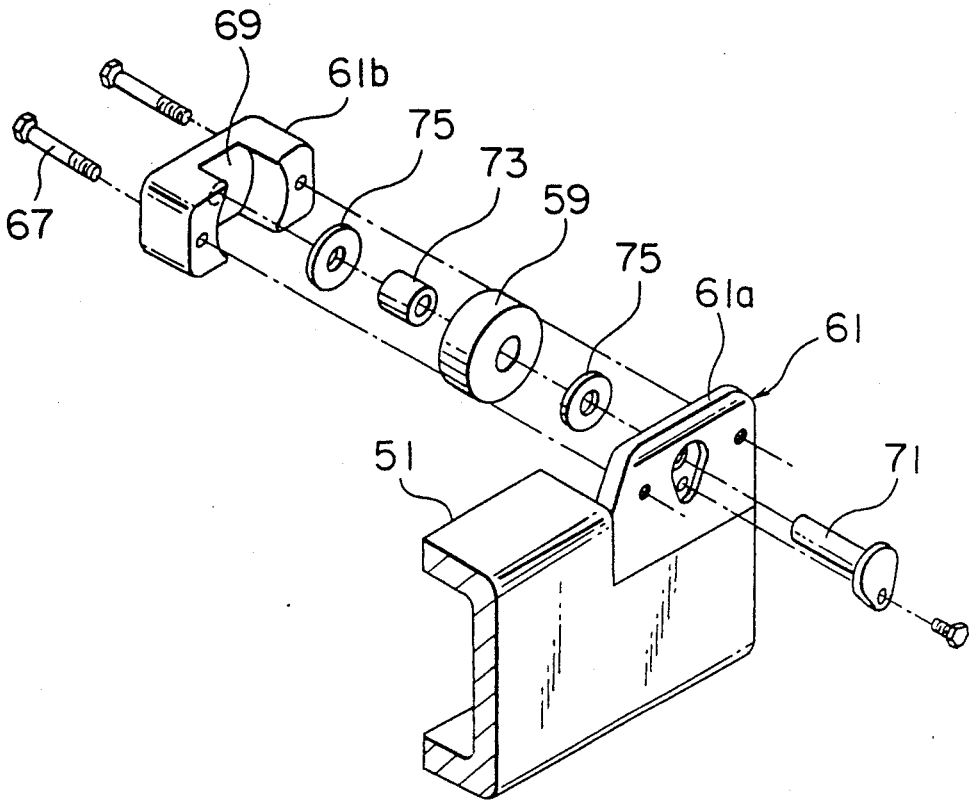
FIG. 8 is an exploded perspective view showing the mounting structure of the outer mast roller in the upright assembly of this invention.

As shown in FIG. 8, the roller bracket 61 for the outer mast roller 59 is composed of a combination of a stationary bracket 61*a* fixed by welding or the like to the front face of the outer mast 51 to protrude forwardly, and a protective bracket 61*b* clamped by bolts 67 to the stationary bracket 61*a*. The outer mast roller 59 is disposed in a containing recess 69 formed in the protective bracket 61*b* such that the front and rear portions thereof are exposed, and rotatably associated with a roller pin 71 fixed through the roller bracket 61 through a radial bearing 73 and a pair of right and left thrust bearings 75.

Figure 9:
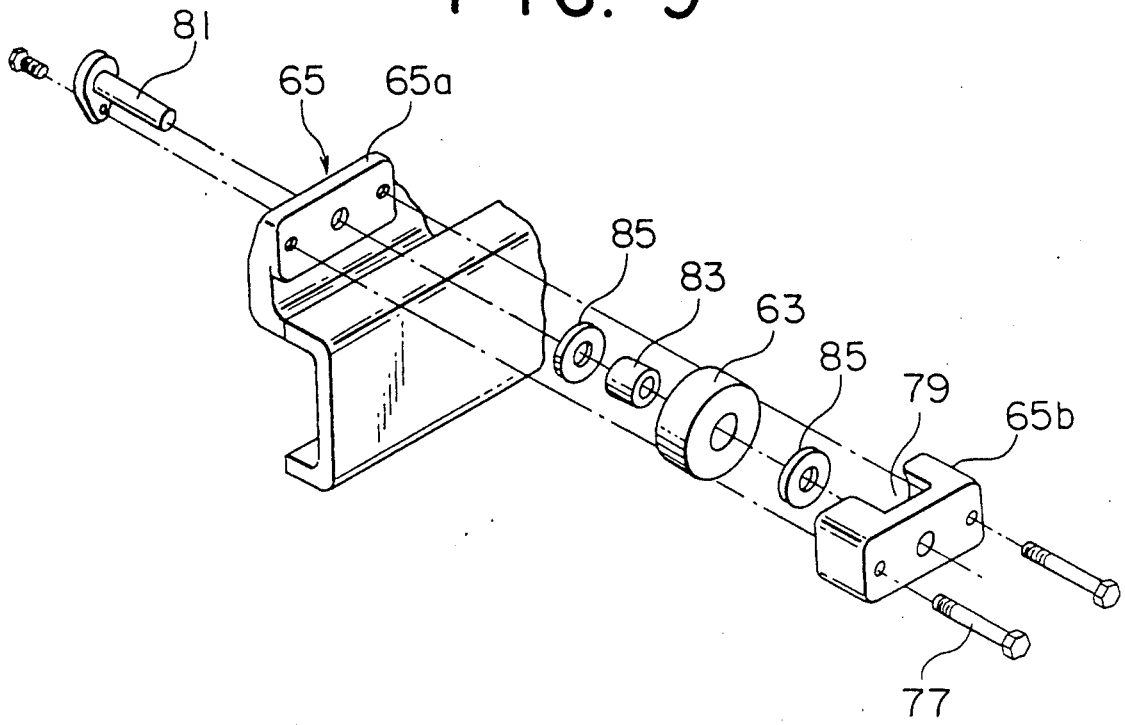
FIG. 9 is an exploded perspective view showing the mounting structure of the inner mast roller in the upright assembly of this invention.

As shown in FIG. 9, the roller bracket 65 for the inner mast roller 63 is composed of a combination of a stationary bracket 65*a* fixed by welding or the like to the front edge face of the inner mast 57 to protrude forwardly, and a protective bracket 65*b* coupled by bolts 77 to the stationary bracket 65*a*. The inner mast roller 63 is disposed in a containing recess 79 formed in the protective bracket 65*b* such that the front and rear portions thereof are exposed, and rotatably associated with a roller pin 81 fixed through the bracket 65 through a radial bearing 83 and a pair of right and left thrust bearings 85.

With the arrangement described above, the outer mast roller 59 and the inner mast roller 63 are protected against dropping articles or the like. Since the roller pins 71 and 81 are supported at..both ends thereof by the roller brackets 61*b* and 65*b*, respectively, the pins are reduced in diameter, and the rollers are hence decreased in diameter, thereby reducing the forward protrusion thereof.

A rear liner 87 slidably contacting the rear outer face of the inner mast 57 is disposed on the rear inner face of the upper end of the outer mast 51, while a front liner 89 slidably contacting the front inner face of the outer mast 51 is disposed on the front outer face of the lower end of the inner mast 57, and rearward (in the direction of arrow R in FIG. 6) moments acting on the inner mast 57 are supported by both the front and rear liners 87 and 89. Generally, rearward moments acting on the inner mast 57 are generated at the time of traveling with an empty load, and are small in magnitude. Accordingly, a supporting structure with the liners 87 and 89 provides sufficient strength.

A mast side roller 91 rolling on the outer laterally facing surface of the web of the inner mast 57 is mounted on the side of the upper end of the outer mast 51, while a side liner 93 sliding on the inner laterally facing surface of the web of the outer mast 51 is mounted on the inner laterally facing surface of the web adjacent to the lower end of the inner mast 57, and rightward and leftward moments are supported by the mast side roller 91 and the side liner 93.

Figure 10:
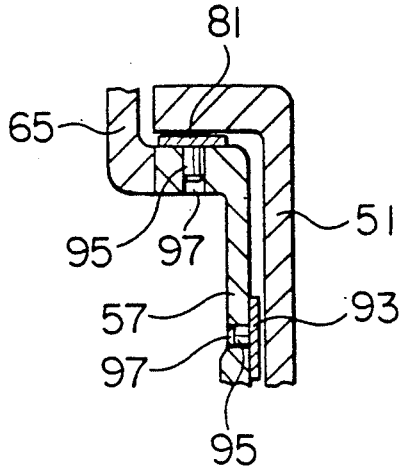
FIGS. 10 and 11 are partial sectional views showing the mounting structure of a liner and a side roller in the upright assembly of the invention.
Figure 11:
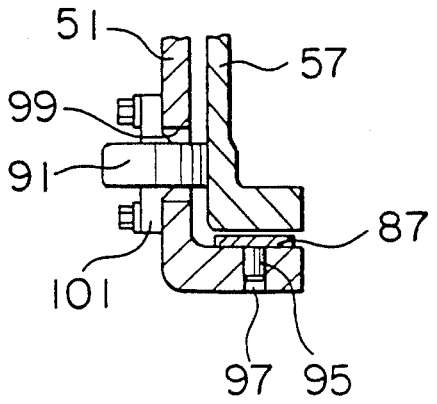
Figure 13:
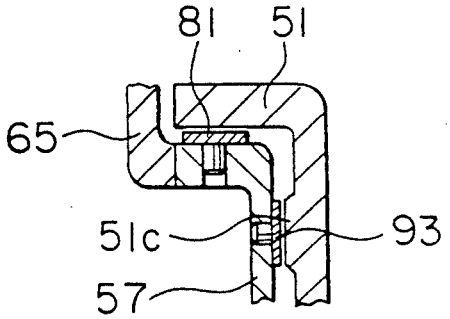
FIG. 13 is a partial sectional view showing a modified embodiment of the mounting structure of the liner.

As shown in FIGS. 10 and 11, the liners 81, 87 and 93 are attached by engaging upper and lower pins 95 provided on the respective liners with holes 97 formed in the masts 51 an 57. The mast side roller 91 is in rolling contact with the outer face of the side of the inner mast 57 through an opening 99 perforated through the outer mast 51 as shown in FIG. 11, and attached to the outer mast 51 through a bracket 101. As shown in FIG. 13, the sliding face of the outer mast 51 on which the side liner 93 of the inner mast 57 slides may be formed on the raised portion 51*c* of the outer mast 51. Forming such a raised portion is advantageous in that it facilitates machining for improving the smoothness of the sliding face.

Figure 5:
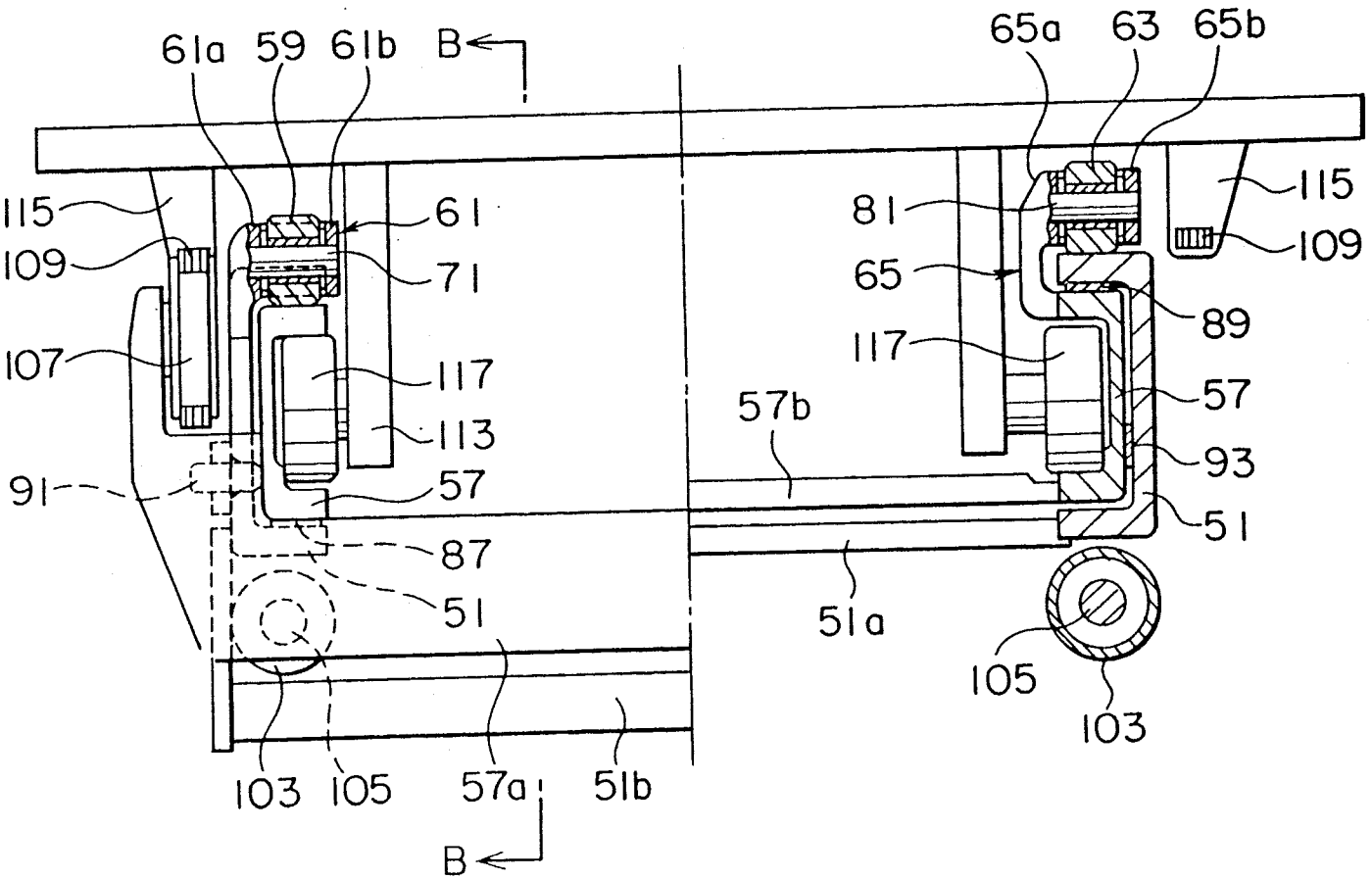
FIG. 5 is a plan view schematically showing an upright assembly according to an embodiment of the present invention with a cross-sectional view of a lower portion of an upright assembly in a right half portion thereof.

As shown in FIG. 5, lift cylinders 103 stand at the rear of the outer masts 51 and are supported at the lower ends thereof on the outer masts 51 by the lower cross beam 51*a* of the outer mast 51 through a bracket (not shown), the upper end of the piston rod 105 being coupled to the upper tie beam 57*a* of the inner mast 57.

As shown in FIG. 5, the upper tie beam 57*a* is so extended as to be introduced to the side of the outer mast 51, and a chainwheel 107 is mounted on the extended portion with the rotating axis thereof lateral thereto. A lift chain 109 engaged with the chainwheel 107 is coupled so that the rear side thereof passes around the outside of the chainwheel 107 to a chain support (not shown) protruding on the outer face of the upper portion of the outer mast 51, and the front side passes the front side of the chainwheel 107 to be coupled on a chain support 115 of a lift bracket 113 for supporting a fork 111. More specifically, the front side coupled on the lift bracket 113 so is disposed as to utilize the projecting plane of the outer mast 51 in the longitudinal direction thereof. The lift bracket 113 is elevationally moved upwardly or downwardly through lift rollers 117 rotatably disposed in the inner space of the inner mast 57. In FIG. 5, symbol 51*b* denotes the upper cross beam of the outer mast 51, and symbol 57*b* denotes the lower tie beam of the inner mast 57.

Figure 12:
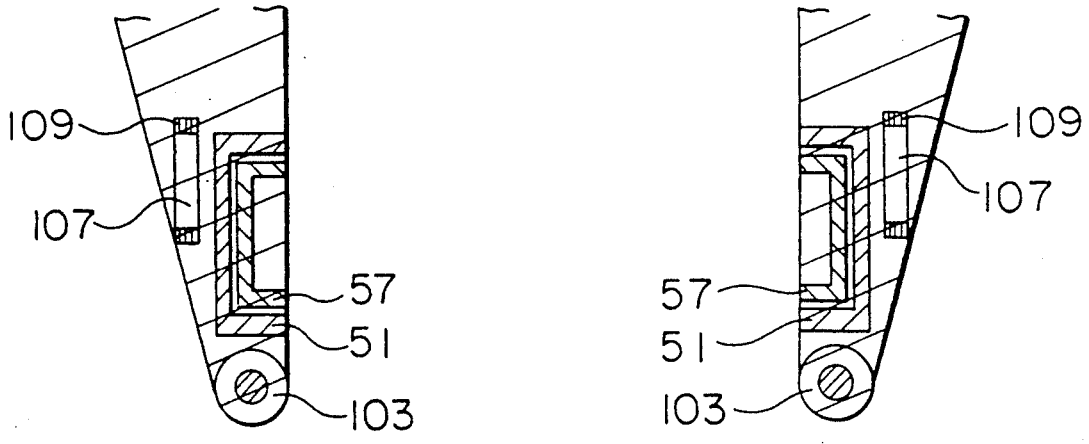
FIG. 12 is a view schematically showing obstruction in the field of view from a driver's seat according to the upright assembly of the invention.

In the upright assembly described above, since the inner mast 57 which obstructs the forward field of view is received in the outer mast 51 and the lift cylinder 103 is also disposed to the rear of the outer mast 51, and further since the front side of the lift chain 109 connected to the lift bracket 113 is disposed on the forward portion of the outside of the mast 51 in a plane projecting from the outer mast 51 in a longitudinal direction thereof, the zone of the forward field of view that is obstructed by the front sides of the inner mast 57, the lift cylinder 103 and the lift chain 109 is narrowed as designated by the shaded portions in FIG. 12, so that a wide forward field of view can be obtained.

Figure 6:
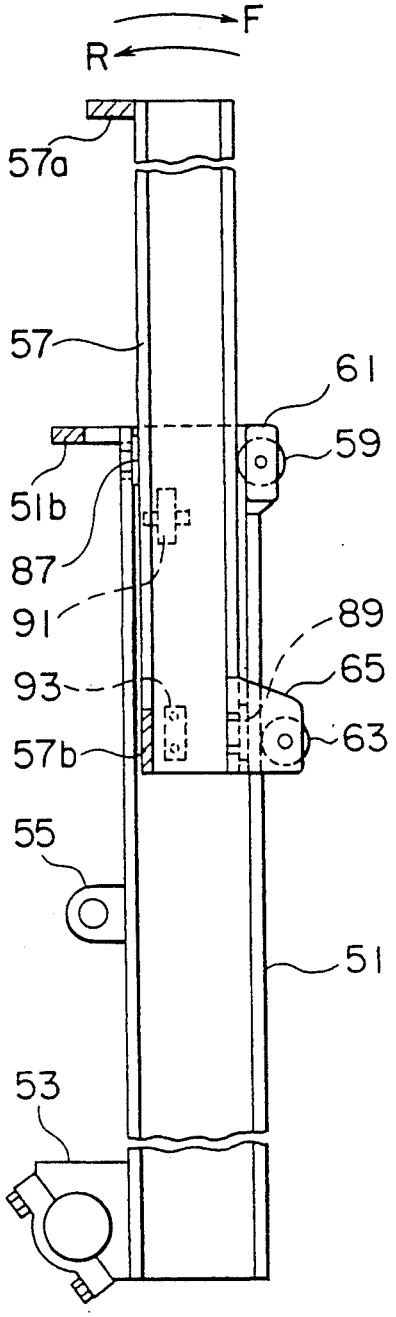
FIG. 6 is a sectional view of an upright assembly taken along the line B—B of FIG. 5, wherein a lift bracket is omitted.
Figure 7:
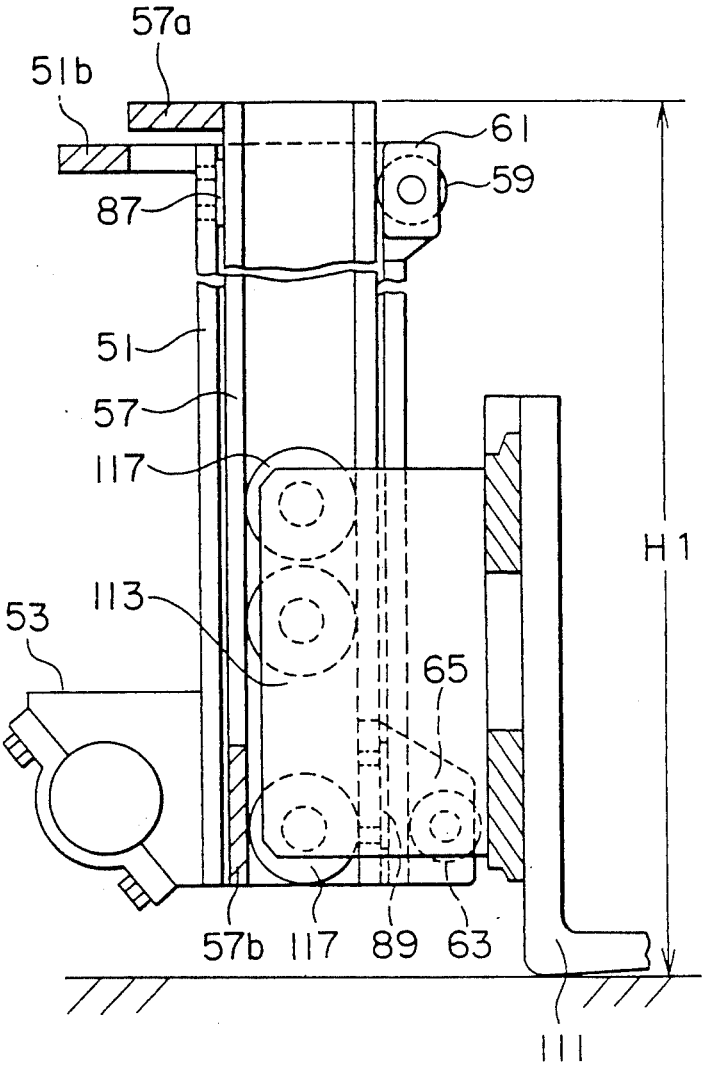
FIG. 7 is a sectional view of an upright assembly taken along the line B—B of FIG. 5, wherein the inner mast is disposed at its lowermost position.

Since large forward moments designated by arrow F in FIG. 6 acting on the inner mast 57 by weights (the weight when a load is carried on the fork lift truck) on the bracket 113 or the forks 111 are supported by the outer mast roller 59 and the inner mast roller 63 in a normal loading work mode, the inner mast 57 can be smoothly elevationally moved with small sliding resistance.

With the arrangement described above, the inner mast roller 63 rolls on the outer face of the front side of the outer mast 51, i.e., a construction wherein it is disposed on the outside of the outer mast 51. Thus, the lift roller 117 on the lowermost portion of the lift bracket 113 can be disposed so as to move to the lower end of the inner mast 57. Accordingly, the upright assembly according to the present invention can utilize the entire length of the inner mast 57 as the effective rolling zone of the lift roller 117 different from conventional roller type upright assemblies wherein the inner mast roller is disposed at the lower end of the inner mast. Therefore, the entire height Hl of the upright assembly can be kept to a lower value.

Figure 14:
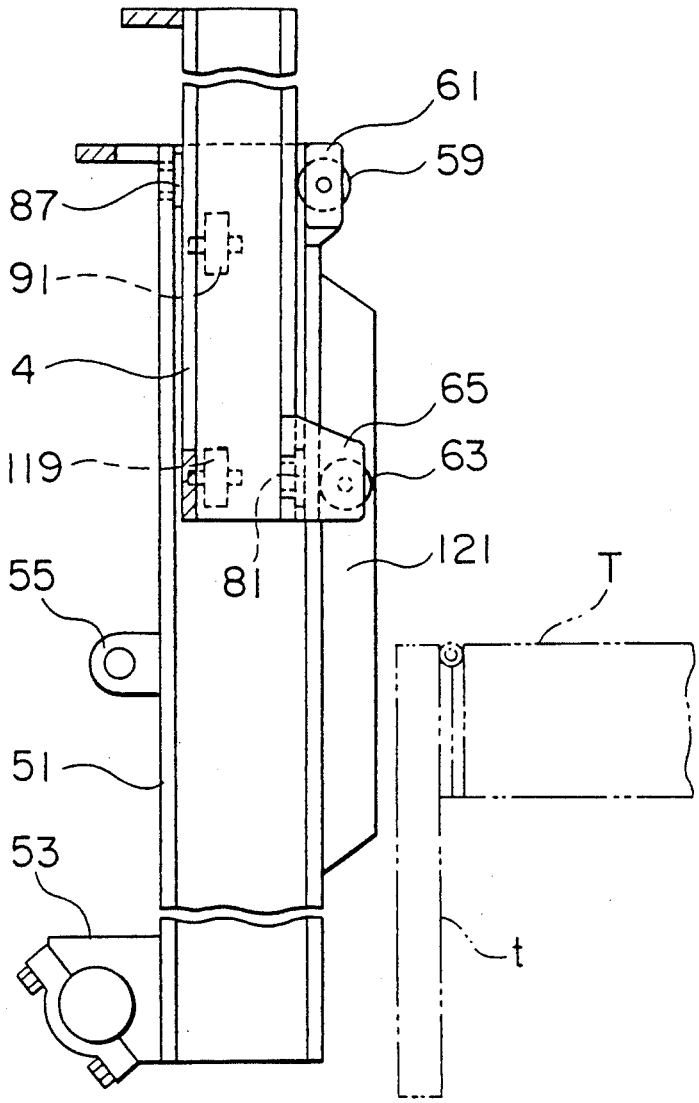
FIG. 14 is a sectional view similar to FIG. 6 showing a modified embodiment of the first embodiment of the invention.
Figure 15:
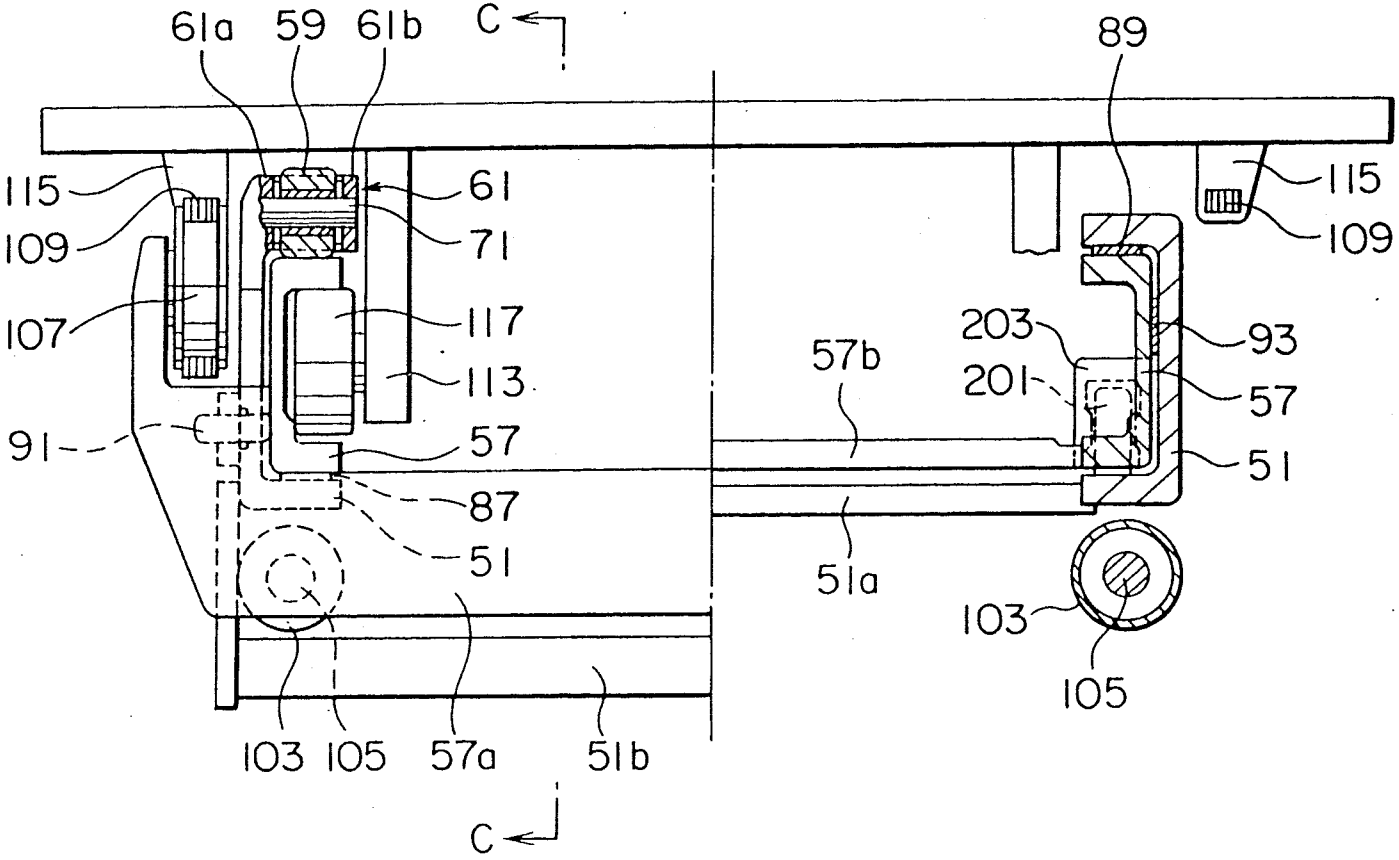
FIG. 15 is a plan view schematically showing a second embodiment of a upright assembly of this invention with a cross-sectional view of the lower portion of the upright assembly in a right half portion thereof.

FIG. 14 shows a modified embodiment of the present invention described above. This modified embodiment is the same as the above-described embodiment in arrangement except that a mast side roller 119 is provided on the side face of the outer mast 51 instead of the side liner 93 of the upright assembly of the first embodiment described above and a longitudinal plate 121 having a protrusion jutting forward to the same extent as that of the inner mast 57 is provided on the front face of the outer mast 51. In other words, the plate 121 protrudes forwardly to substantially the same extent as does the inner mast roller 63 mounted on the lower end of the inner mast 57, as shown in FIG. 14.

Therefore, in this modified embodiment, lateral moments from eccentric loads acting on the inner mast 57 when loading freight are supported by the mast side roller 91 of the outer mast 51 and the mast side roller 119 of the inner mast 57. Thus, the sliding resistance of the inner mast 57 when elevating up or down can be further effectively reduced. Also, since the closest that the outer mast 51 can come to the rear deck T of a truck can be restricted by the plate 121 of the outer mast 51 when loading or unloading the truck as designated by the imaginary lines in the drawing, interference of the inner mast roller 63 with the gate t of the rear deck T is avoided where the outer mast 51 approaches the rear deck T, thereby preventing damage to the gate t or the inner mast roller 63 beforehand Though not shown, the side mast roller 119 of the inner mast 57 shown in FIG. 14, and the side liner 93 of the first embodiment may be provided together, so that lateral moments may be supported by the side roller 91 of the outer mast 51 and the side liner 93 of the inner mast 57 when the inner mast 57 is down resulting in the overlap area of the inner mast 57 and the outer mast 51 being large. When the inner mast 57 is up resulting in a small overlap area, lateral moments may be supported by the mast side roller 91 of the outer mast 51 and the mast side roller 119 of the inner mast 57.

Referring to FIGS. 15–18, a second embodiment of the present invention will next be described. The second embodiment differs from the first embodiment in the mounting state of the inner mast roller, but the other portions thereof are substantially the same, wherein the same reference numerals as those in the first embodiment denote the same or equivalent components, and descriptions thereof will be omitted.

Figure 18:
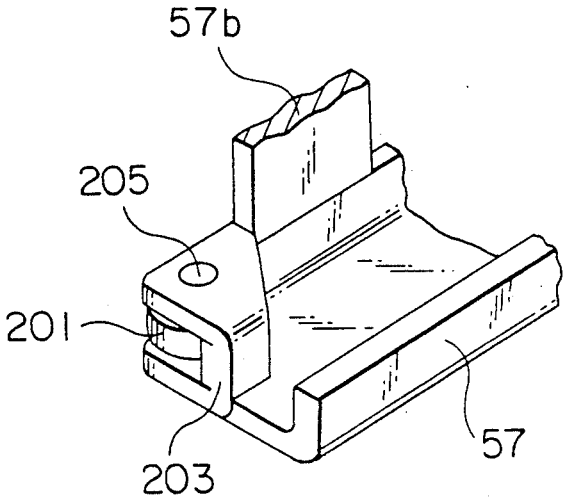
FIG. 18 is a perspective view showing the mounting structure of the inner mast roller in the upright assembly of the second embodiment.

As shown in the drawing, an inner roller 201 is mounted by a roller bracket 203 to the lower end of the inner mast 57 so as to roll on the inner face of the rear side of the outer mast 51. As best shown in FIG. 18, the roller bracket 203 for the inner mast roller 201 is fixed by welding or the like to the corner of the lower end of the rear side of the inner mast 57. The roller bracket 203 is formed substantially in a U-shape in a horizontal plane, and substantially in a triangular shape in a side plane, and the front face thereof opposite the lift roller 117 of the lowermost portion of the lift bracket 113 is oblique. The inner mast roller 201 is disposed in the inner space of the roller bracket 203, and rotatably mounted at both ends there of by roller pins 205 supported to the roller brackets 203.

Figure 16:
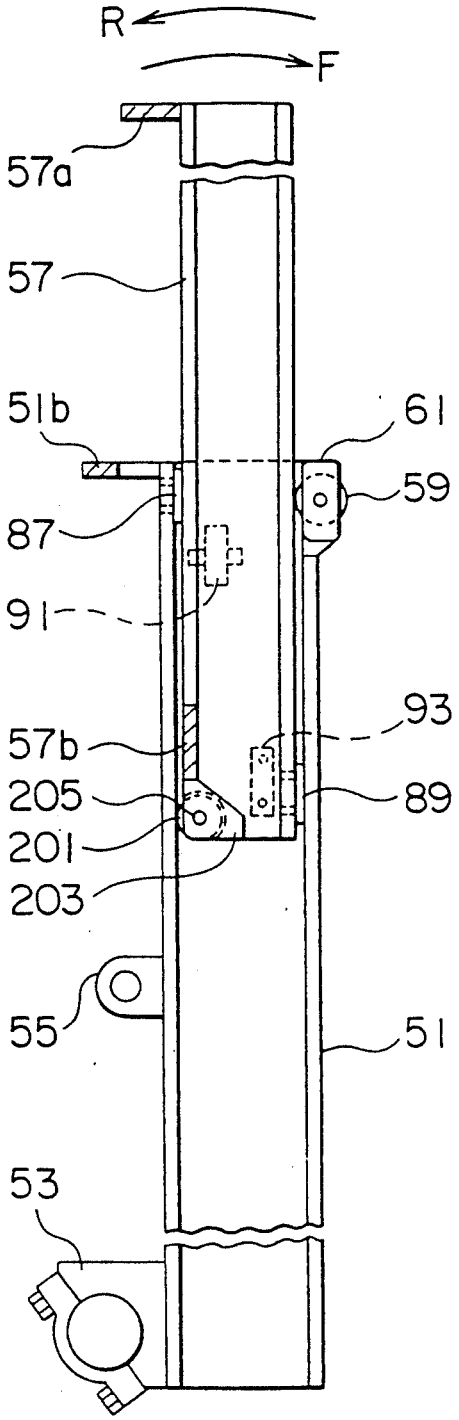
FIG. 16 is a sectional view of an upright assembly taken along the line C—C of FIG. 15.

Large forward moments designated by an arrow F in FIG. 16 act on the inner mast 57, and these moments are supported by the outer mast roller 59 rolling on the outer face of the front side of the inner mast 57 and the inner mast roller 201 rolling on the inner face of the rear side of the outer mast 51.

Figure 17:
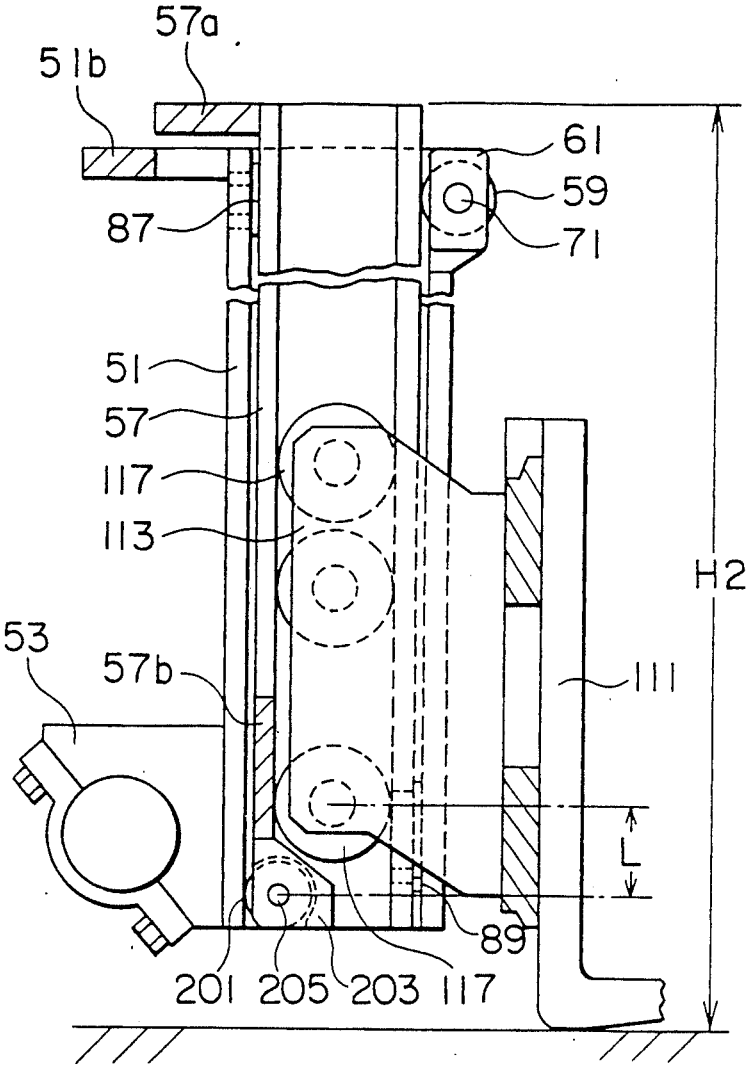
FIG. 17 is a sectional view of an upright assembly taken along the line C—C of FIG. 15 with the view showing the state wherein the inner mast is disposed at its lowermost position.

In the second embodiment described above, the roller pin 205 of the inner mast roller 201 is supported, similarly to the first embodiment, at both ends thereof by the roller bracket 203. Thus, the pin can be reduced in diameter, and the roller can hence be decreased in diameter. In addition, since the roller bracket 203 itself is formed substantially in the triangular shape with the front side being oblique, the rising size from the lower end of the inner mast 57, i.e., the range of interference with the lift roller 117 can be reduced. Therefore, as shown in FIG. 17, a distance L between axes of the inner mast roller 201 and the lift roller 117 when the lift bracket 113 is disposed at the lowermost position can be considerably decreased. As a result, the entire height H2 of the upright assembly can be kept to a lower value as compared with that of conventional roller type upright assemblies.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely preferred or exemplary embodiments thereof.

What is claimed is:

1. An upright assembly for a forklift truck, comprising a U-shaped cross-sectional outer mast having an upper end and a lower end and oriented facing a side of said truck to thereby provide an outer mast front leg having inner and outer surfaces and an outer mast rear leg having inner and outer surfaces, and a U-shaped cross-sectional inner mast having an upper end and a lower end and slidably received within the U-shape of said outer mast to thereby provide an inner mast front leg having an outer surface cofacing said outer mast front leg inner surface and an inner mast rear leg having an outer surface cofacing said outer mast rear leg inner surface, an outer mast roller mounted on said upper end of the outer mast in rolling engagement with said inner mast front leg outer surface, a rear liner attached to said outer mast rear leg inner surface adjacent to said outer mast upper end and in sliding engagement with said inner mast rear leg outer surface, an inner mast roller mounted on said lower end of the inner mast in rolling engagement with said outer mast front leg outer surface, and a front liner attached to said inner mast front leg outer surface adjacent to said inner mast lower end and in sliding engagement with said outer mast front leg inner surface.

2. An upright assembly as claimed in claim 1, wherein said inner mast roller is mounted on a roller bracket attached to said inner mast lower end and extending forwardly of, and around said outer mast front leg so as to be clear of engagement with said outer mast.

3. An upright assembly according to claim 2, wherein said outer mast front leg outer surface has a longitudinal plate attached thereto adjacent to said inner mast roller bracket and extending substantially between said outer mast upper and lower ends, said longitudinal plate projecting forwardly of said outer mast front leg substantially to the same extent as said inner mast roller bracket extends forwardly of said outer mast front leg.

4. An upright assembly as claimed in claim 1, wherein the web of said U-shaped outer mast provides laterally facing, respectively opposite inner and outer side surfaces of said outer mast, and the web of said U-shaped inner mast provides laterally facing, respectively opposite inner and outer side surfaces of said inner mast, and which further comprises a mast side roller mounted on said outer mast inner side surface adjacent to said outer mast upper end and in rolling engagement with said inner mast outer side surface, and a side liner mounted on said inner mast outer side surface adjacent to said inner mast lower end and in sliding engagement with said outer mast inner side surface, whereby said side roller and said side liner receive lateral force moments acting on said inner mast.

5. An upright assembly as claimed in claim 4, wherein said outer mast inner side surface has a laterally projecting sliding surface extending substantially between said outer mast upper and lower ends, said side liner being in sliding contact with said outer mast sliding surface.

6. An upright assembly as claimed in claim 1, wherein the web of said U-shaped outer mast provides laterally facing, respectively opposite inner and outer side surfaces of said outer mast, and the web of said U-shaped inner mast provides laterally facing, respectively opposite inner and outer side surfaces of said inner mast, and which further comprises an outer mast side roller mounted on said outer mast inner side surface adjacent to said outer mast upper end and in rolling engagement with said inner mast outer side surface, and an inner mast side roller mounted on said inner mast outer side surface adjacent to said inner mast lower end and in rolling engagement with said outer mast inner side surface, whereby said inner mast and outer mast side rollers receive lateral force moments acting on said inner mast.

7. An upright assembly for a forklift truck comprising a U-shaped cross-sectional outer mast having an upper end and a lower end and oriented facing a side of said truck to thereby provide an outer mast front leg having inner and outer surfaces and an outer mast rear leg having inner and outer surfaces, and a U-shaped cross-sectional inner mast having an upper end and a lower end and slidably received within the U-shape of said outer mast to thereby provide an inner mast front leg having an outer surface cofacing said outer mast front leg inner surface and an inner mast rear leg having an outer surface cofacing said outer mast rear leg inner surface, an outer mast roller mounted on said upper end of the outer mast in rolling engagement with said inner mast front leg outer surface, a rear liner attached to said outer mast rear leg inner surface adjacent to said outer mast upper end and in sliding engagement with said inner mast rear leg outer surface, and an inner mast lower roller mounted on said lower end of the inner mast adjacent to, and projecting rearwardly of said inner mast rear leg in rolling engagement with said outer mast rear leg inner surface.

8. An upright assembly for a forklift truck according to claim 7, wherein the web of said U-shaped outer mast provides laterally facing, respectively opposite inner and outer side surfaces of said outer mast, and the web of said U-shaped inner mast provides laterally facing, respectively opposite inner and outer side surfaces of said inner mast, and which further comprises an inner mast lower roller bracket including a laterally disposed roller pin on which said inner mast lower roller is mounted, said inner mast lower roller bracket having an oblique front side, and a vertically movable forklift apparatus having a lift mounting bracket extending rearwardly therefrom adjacent and substantially parallel to said web of said U-shaped inner mast, said lift mounting bracket having a lower edge and carrying a lift roller mounted thereon adjacent to and projecting below its said lower edge and received within said inner mast U-shape for rolling engagement along one of said inner mast front and rear legs, whereby said lift roller is disposed closely adjacent to said oblique front side of said inner mast lower roller bracket when said forklift if in a fully lowered position of its said vertical movement.

9. An upright assembly as claimed in claim 8, which further comprises a mast side roller mounted on said outer mast inner side surface adjacent to said outer mast upper end and in rolling engagement with said inner mast outer side surface, and a side line mounted on said inner mast outer side surface adjacent to said inner mast lower end and in sliding engagement with said outer mast inner side surface, whereby said side roller and said side liner receive lateral force moments acting on said inner mast.

10. An upright assembly as claimed in claim 9, wherein said outer mast inner side surface has a laterally projecting sliding surface extending substantially between said outer mast upper and lower ends, said side liner being in sliding contact with said outer mast sliding surface.

11. An upright assembly as claimed in claim 8, which further comprises an outer mast side roller mounted on said outer mast inner side surface adjacent to said outer mast upper end and in rolling engagement with said inner mast outer side surface, and an inner mast side roller mounted on said inner mast outer side surface adjacent to said inner mast lower end and in rolling engagement with said outer mast inner side surface, whereby said inner mast and outer mast side rollers receive lateral force moments acting on said inner mast.

12. An upright assembly for a forklift truck, comprising a pair of laterally spaced apart and laterally joined U-shaped cross-sectional outer masts each having an upper end and a lower end and oriented facing a side of said truck to thereby provide with respect to each an outer mast front leg having inner and outer surfaces and an outer mast front leg having inner and outer surfaces, and a pair of U-shaped cross-sectional inner masts each having an upper end and a lower end and slidably received within the U-shape of respectively associated ones of said outer masts to thereby provide with respect to each an inner mast front leg having an outer surface cofacing said outer mast front leg inner surface of its said associated outer mast and an inner mast rear leg having an outer surface cofacing said outer mast rear leg inner surface of its said associated outer mast, an outer mast roller mounted on said upper end of each said outer mast in rolling engagement with said front leg outer surface of its said associated inner mast, a rear liner attached to said outer mast rear leg inner surface adjacent to said upper end of each said outer mast in sliding engagement with said rear leg outer surface of its said associated inner mast, an inner mast lower roller mounted on said lower end of said inner masts in rolling engagement with one of said outer mast front leg outer surface and said outer mast rear leg inner surface of its said associated outer mast, the web of each said U-shaped outer mast providing laterally facing, respectively opposite inner and outer side surfaces thereof, and the web of each said U-shaped inner mast providing laterally facing, respectively opposite inner and outer side surfaces thereof, and a mast side roller mounted on said outer mast inner side surface adjacent to said upper end of each said outer mast, each said mast side roller being in rolling engagement with said outer side surface of its said associated inner mast.

13. An upright assembly as claimed in claim 12, which further comprises a side liner mounted on said inner mast outer side surface adjacent to said lower end of each said inner mast, each said side liner being in sliding engagement with said inner side surface of its said associated outer mast.

14. An upright assembly as claimed in claim 12, which further comprises an inner mast side roller mounted on said inner mast outer side surface adjacent to said lower end of each said inner mast, each said inner mast side roller being in rolling engagement with said inner side surface of its said associated outer mast.

* * * * *

UNITED STATES PATENT AND TRADEMARK OFFICE

CERTIFICATE OF CORRECTION

PATENT NO. : 5,046,585

DATED : September 10, 1991

INVENTOR(S) : M. Ohta et al

It is certified that error appears in the above-identified patent and that said Letters Patent is hereby corrected as shown below:

Col. 2, line 28, "Of" should read "of".

Col. 5, line 1, after "at", delete ".."; line 2, after "brackets" insert --61,--; after "and" insert --65,--; line 61, after "113", change "so is" to --is so--.

Col. 9, line 42, change "if" to --is--.

Col. 10, line 17, change "front" to --rear--.

Signed and Sealed this

Twenty-seventh Day of April, 1993

*Attest:*

MICHAEL K. KIRK

*Attesting Officer*

*Acting Commissioner of Patents and Trademarks*